US007643648B2

(12) United States Patent
Kaiya et al.

(10) Patent No.: US 7,643,648 B2
(45) **Date of Patent: *Jan. 5, 2010**

(54) SPEAKER DEVICE

(75) Inventors: Teruaki Kaiya, Yamagata (JP); Seiya Sato, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 864 days.

This patent is subject to a terminal disclaimer.

(21) Appl. No.: 11/257,113

(22) Filed: Oct. 25, 2005

(65) Prior Publication Data

US 2006/0088180 A1 Apr. 27, 2006

(30) Foreign Application Priority Data

Oct. 25, 2004 (JP) ..... 2004-309329
Dec. 24, 2004 (JP) ..... 2004-374313

(51) Int. Cl.
*H04R 25/00* (2006.01)

(52) U.S. Cl. ..... 381/400; 381/396; 381/423

(58) Field of Classification Search ..... 381/396, 381/398, 400, 423–426, 432–433
See application file for complete search history.

(56) References Cited

U.S. PATENT DOCUMENTS 4,764,968 A * 8/1988 Kreitmeier ..... 381/432
5,734,734 A 3/1998 Proni
6,496,590 B2 12/2002 Proni
6,501,844 B2 12/2002 Proni
6,639,993 B2 10/2003 Kemmerer et al.
7,203,333 B2 * 4/2007 Funahashi et al. ..... 381/424
7,209,570 B2 * 4/2007 Funahashi et al. ..... 381/398
7,515,728 B2 * 4/2009 Kobayashi et al. ..... 381/398

FOREIGN PATENT DOCUMENTS

DE 44 07 232 11/1995
EP 0 912 072 A1 4/1999
JP 61-9097 1/1986

* cited by examiner

*Primary Examiner*—Suhan Ni
(74) *Attorney, Agent, or Firm*—Young & Thompson

(57) ABSTRACT

A speaker device includes a vibration system, having a voice coil bobbin, a diaphragm, a supporting cap and a cap, and a magnetic circuit system. The inner peripheral edge portion of the diaphragm is mounted on an area in the vicinity of the upper end portion of the outer peripheral wall of the voice coil bobbin. The projecting portion of the cap is inserted into the opening of the supporting cap, and the supporting cap is placed under the cap. Each of the projecting portions of the cap is fixed to each of the correspondent recessed portions of the diaphragm, and the claw portion of the cap is fixed to the projecting portion of the diaphragm and the third flat portion.

11 Claims, 11 Drawing Sheets

SPEAKER DEVICE

BACKGROUND OF THE INVENTION

1. Field of the Invention

The present invention relates to a mounting structure of a cap and a diaphragm in a speaker device.

2. Description of Related Art

Conventionally, there is known an external-magnet type speaker device including a vibration system having a voice coil bobbin, a diaphragm and a cap having a dustproof function, and a magnetic circuit system having a yokes a magnet and a plate. In such a speaker device, one portion (mounting surface), of an outer peripheral edge portion of the cap is mounted on an area in the vicinity of an outer peripheral edge portion of the diaphragm via an adhesive, and the cap is arranged at a position covering an upper surface of the voice coil bobbin, for example.

There is known a speaker device in which the outer peripheral edge portion of the diaphragm having an upper-side diaphragm and a lower-side diaphragm is mounted onto an inner side edge (see U.S. Pat. No. 6,496,590 and No. 6,501,844, for example). In addition, there is known the speaker device in which the outer peripheral edge portion of a dustproof cap is mounted onto the side of the outer peripheral edge portion of the diaphragm via an adhesive tape (see U.S. Pat. No. 6,639,993, for example). Moreover, there is known the speaker device in which an opening is formed on a pole piece (see U.S. Pat. No. 5,734,734, for example).

However, in the above-mentioned speaker device, a mounting surface (attachment surface) of the cap to the diaphragm is positioned on the side of the outer peripheral edge portion of the cap, and an adhesion area of the cap and the diaphragm is small. Therefore, a vibrating area of the cap at the time of driving of the speaker device is large, and due to the vibration, an abnormal sound (flutter) problematically occurs from the cap. As a method of avoiding such a problem, there is known a method of making the cap thicker so that the vibration of the cap hardly occurs, thereby preventing the occurrence of the abnormal sound (flutter) However, if such a method is employed, the cap becomes heavy by the amount of increased thickness of the cap, and sensitivity of the speaker device decreases as a new problem

SUMMARY OF THE INVENTION

The present invention has been achieved in order to solve the above problems. It is an object of this invention to provide a speaker device, having a mounting structure of a cap and a diaphragm, capable of preventing occurrence of an abnormal sound (flutter) of the cap.

According to one aspect of the present invention, there is provided a speaker device including: a voice coil bobbin; a diaphragm which is mounted on the voice coil bobbin; and a cap which is positioned in front of the diaphragm and at a position covering the voice coil bobbin, wherein the diaphragm has a first fixing portion in a vicinity of an outer peripheral portion thereof and a second fixing portion in a vicinity of a middle portion thereof, and wherein an outer peripheral portion of the cap is bonded to the outer peripheral portion of the diaphragm or the first fixing portion, and a portion of the cap opposite to the second fixing portion is bonded to the second fixing portion.

The above speaker device includes the voice coil bobbin, the diaphragm formed into a cone shape, mounted onto the voice coil bobbin, and the cap positioned in front of the diaphragm, i.e., on a sound output side, and at the position covering the voice coil bobbin and having a dustproof function, for example.

The speaker device includes the first fixing portion in the vicinity of the outer peripheral portion of the diaphragm, and the second fixing portion in the vicinity of the middle portion of the diaphragm. The outer peripheral portion of the cap is bonded (fixed) to the outer peripheral portion of the diaphragm or the first fixing portion via an adhesion component for example. In addition, the portion of the cap opposite to the second fixing portion is bonded to the second fixing portion via the adhesion component, for example. Namely, the cap is bonded to the diaphragm in a manner divided into the inner side portion and the outer side portion of the second fixing portion, with the substantial middle portion as a border thereof.

Therefore, when the voice coil bobbin is driven in the axis direction of the speaker device, the diaphragm and the cap accordingly vibrate in the axis direction, too. A vibrating area of the cap is an inner side portion of the second fixing portion, so the outer side portion of the second fixing portion hardly vibrates. This is mainly because supporting strength of the diaphragm is larger at the outer side portion of the second fixing portion than the inner side portion of the second fixing portion and the outer side portion of the second fixing portion is hard to vibrate. Thus, in the speaker device, at the time of driving, the vibrating area of the cap is small, and the occurrence of the abnormal sound (flutter) from the cap can be prevented. Additionally, as described above, since the cap and the diaphragm are bonded at two positions, i.e., at the first fixing portion and the second fixing portion, a bonding area therebetween increases in comparison with the case that the cap and the diaphragm are fixed only at the outer peripheral edge portions thereof. Thus, the occurrence of the abnormal sound can be prevented without making the diaphragm and the cap thicker, and the strength of the diaphragm and the bonding strength between the diaphragm and the cap can be improved Hence, the diaphragm and the cap can be lighter, and sensitivity of the speaker device can be improved.

In a preferred example, the first fixing portion may have a projecting portion on a side opposite to the cap, and the outer peripheral portion of the cap may have a hook-shape claw portion on a side opposite to the diaphragm; and the claw portion and the projecting portion may contact to be bonded. In addition, the second fixing portion may have plural recessed portions on a side of the cap; plural projecting portions may be formed at the portion of the cap opposite to the second fixing portion; and the plural projecting portions may be inserted into the plural correspondent recessed portions, and the plural projecting portions and the plural recessed portions may be bonded. Moreover, in a preferred example, the speaker device may further include an edge and a frame, wherein an inner peripheral portion of the edge is mounted onto the outer peripheral portion of the diaphragm, and an outer peripheral portion of the edge is mounted onto the frame.

In another form of the above speaker device, a supporting cap may be provided between the voice coil bobbin and the cap; and the supporting cap may be bonded to the cap, and an outer peripheral portion of the supporting cap may be bonded between the voice coil bobbin and the diaphragm by an adhesion component.

In accordance with the form, the supporting cap formed into the cup shape is provided between the voice coil bobbin and the cap, for example. The supporting cap is bonded to the cap. The outer peripheral portion of the supporting cap is bonded between the voice coil bobbin and the diaphragm by the adhesion component. Thereby, the bonding strength between the cap and the diaphragm can be further improved.

In a preferred example, the supporting cap may have a contact surface contacting the cap, and may have an opening at a substantial center of the contact surface; the cap may have a projecting portion projecting at a position corresponding to the opening and on a side opposite to the supporting cap; and the projecting portion of the cap may be inserted into the opening of the supporting cap. Thereby, the supporting cap can be mounted onto an appropriate position of the cap.

In another form of the above speaker device, the supporting cap may have a ventilation portion.

In the speaker device including the supporting cap having no ventilation portion, as the voice coil bobbin moves to the side opposite to the sound output side, the space existing among the supporting cap, the voice coil bobbin and the magnetic circuit is compressed, and the pressure in the space becomes high. Thereby, the voice coil bobbin becomes hard to move in the direction. That is, a mechanical resistance at the time of the movement of the voice coil bobbin increases.

As for this point, in the above speaker device, since the supporting cap has the ventilation portion, even when the voice coil bobbin moves to the side opposite to the sound output side, the space is not compressed, and the pressure in the space does not become high. Therefore, the voice coil bobbin can easily move to the side opposite to the sound output side, and the mechanical resistance at the time of the movement of the voice coil bobbin can be decreased. Thereby, a deterioration of sound quality can be prevented.

In a preferred example, the supporting cap may have an opening as a ventilation portion at a position facing a space existing among the supporting cap, the diaphragm and the cap. In addition, the supporting cap may have an opening as a ventilation portion between the contact surface and the outer peripheral portion.

In addition, in the speaker device including the supporting cap having no ventilation portion, as the voice coil bobbin moves to the side opposite to the sound output side, the pressure in the space existing among the supporting cap, the voice coil bobbin and the magnetic circuit becomes high. Thus, the strength (bonding strength) of the components of the vibration system in the speaker device has to be reinforced. In this point, in the above speaker device, since the permeability is ensured, the pressure in the space does not become high. Therefore, the strength (bonding strength) of the components of the vibration system does not have to be reinforced in a positive manner. Namely, since the above-mentioned speaker device includes the ventilation portion, the strength (bonding strength) among the respective components of the vibration system becomes high at the time of the driving of the speaker device, in comparison with the speaker device including no ventilation portion. This is called "reinforcement effect". Thereby, the vibration system can be operated with appropriate softness. As a result, the vibration system can be appropriately controlled, and the speaker device can be easily in a still state. Namely, a damping effect can be improved.

In another form of the above speaker device, a portion of the supporting cap facing a space existing among the supporting cap, the diaphragm and the cap, a part of the portion or the entire supporting cap may be formed by a material having permeability, e.g., a material such as a fabric on which large meshes are formed. Thereby, the effect similar to the case that the opening is provided on the supporting cap as the ventilation portion can be obtained, and the mechanical resistance at the time of the movement of the voice coil bobbin can be decreased. Hence, the deterioration of the sound quality can be prevented.

In another form of the above speaker device, the diaphragm may have an opening at a position facing a space existing among the supporting cap, the diaphragm and the cap. Thereby, the space existing among the supporting cap, the diaphragm and the cap is connected to the space existing among the diaphragm, the edge and the frame via the opening. In still another form of the above speaker device, the frame may have an opening at a position facing a space existing among the frame, the diaphragm and the edge. Thereby, the space existing among the frame, the diaphragm and the edge is connected to the external space of the speaker device via the opening. Therefore, in accordance with the form, it can be further prevented that the pressure of the space existing among the supporting cap, the voice coil bobbin and the magnetic circuit becomes high, and the mechanical resistance at the time of the movement of the voice coil bobbin can be decreased. Hence, the deterioration of the sound quality can be further prevented.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings First Embodiment In a first embodiment, it is prevented that an abnormal sound (flutter) occurs from the cap at the time of the driving of the speaker device, by bonding the cap and the diaphragm at a predetermined position.

(Configuration of Speaker Device)

Figure 1:
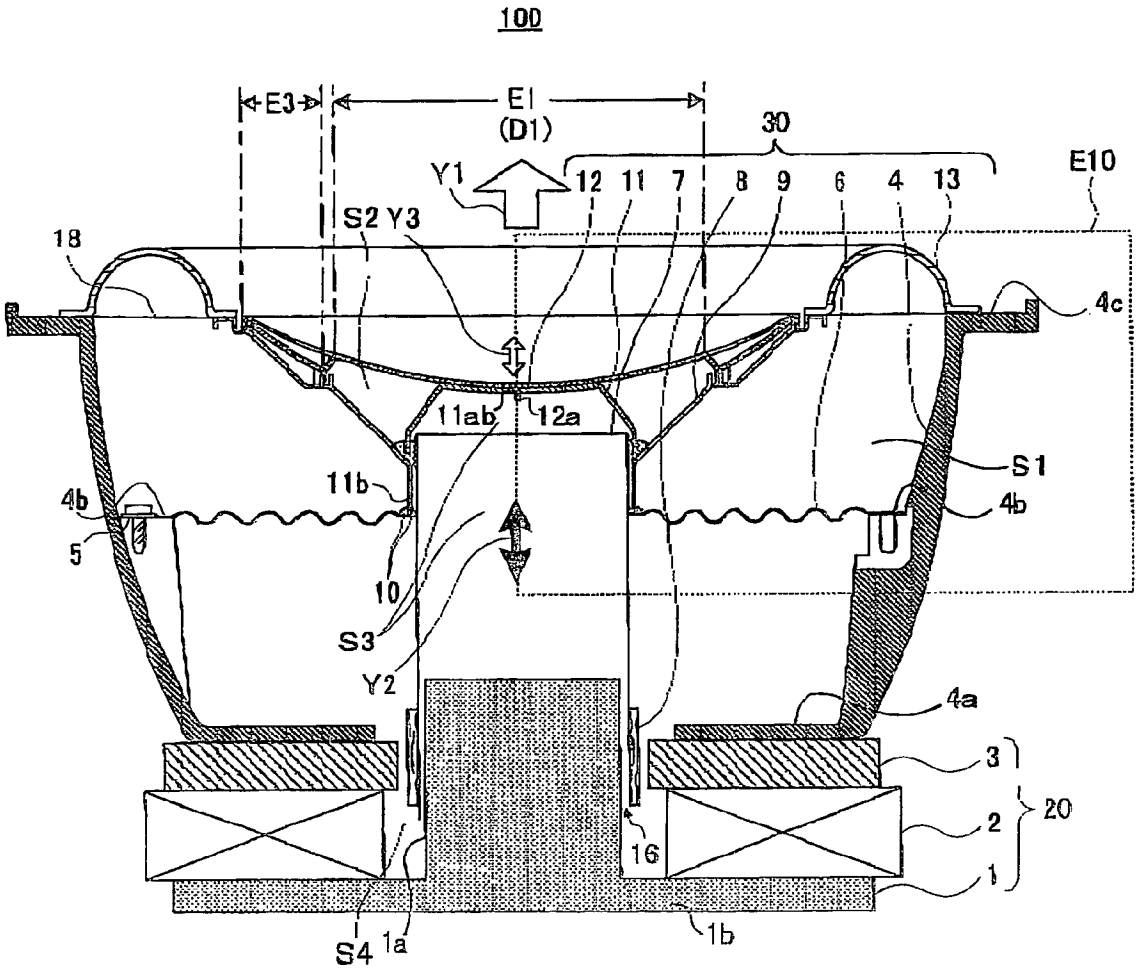
FIG. 1 shows a cross-sectional view of a speaker device according to a first embodiment of the present invention.

FIG. 1 schematically shows a configuration of a speaker device 100 according to the first embodiment of the present invention. The speaker device 100 of the first embodiment is the so-called subwoofer-type speaker device. Therefore, the speaker device 100 of this embodiment can be preferably used as an on-vehicle speaker. FIG. 1 shows a cross-sectional view when cutting the speaker device 100 by a plane including a central axis thereof. The description will be given of the configuration of the speaker device 100 of the first embodiment with reference to FIG. 1 to FIGS. 4A and 4B, below.

As shown in FIG. 1, the speaker device 100 mainly includes a magnetic circuit system 20 having a yoke 1, a magnet 2 and a plate 3, a vibration system 30 having a frame 4, a damper 6, a voice coil bobbin 7, a voice coil B, a diaphragm 9, an edge 13, a supporting cap 11 and a cap 12, and plural terminal members 5, and a mounting member 18 as various kinds of members.

First, the description will be given of respective components of the magnetic circuit system 20.

The magnetic circuit system 20 is configured as an external-magnet type magnetic circuit. The yoke 1 has a cylindrical pole portion 1*a* and a flange portion 1*b* extending in an outward direction from an outer peripheral wall thereof. The annular magnet 2, which is formed into an annular shape, is fixed onto an upper surface of the flange portion 1*b* being the component of the yoke 1. The annular plate 3, which is formed into an annular shape, is fixed onto the annular magnet 2. In the magnetic circuit system 20, the magnetic circuit is constructed by the magnet 2 and the plate 3, and magnetic flux of the magnet 2 concentrates on a magnetic gap 16 formed between an inner peripheral wall of the plate 3 and an outer peripheral wall of the pole portion 1*a*.

Next, the description will be given of respective components of the vibration system 30.

The various components of the speaker device 100 are fixed onto the frame 4, and the frame 4 serves as supporting member of the components. The frame 4 has a first flat portion 4*a*, a second flat portion 4*b* and a third flat portion 4*c*, whose upper surfaces ensure flatness. The first flat portion 4*a* is formed at a position on the lower side of the frame 4. The lower surface of the first flat portion 4*a* is fixed onto the annular magnet 3. The second flat portion 4*b* is formed at a substantial middle position of the frame 4. Onto an upper surface of the second flat portion 4*b*, the outer peripheral edge portion of the damper 6 is fixed. The third flat portion 4*c* is formed at a position on an upper side of the frame 4. Onto an upper surface of the third flat portion 4*c*, an outer peripheral edge portion of the mounting member 18, which will be described later, is mounted.

The voice coil bobbin 7 is formed into a substantially cylindrical shape. The voice coil 8, which will be described later, is wound around the vicinity of the lower end portion of the outer peripheral wall of the voice coil bobbin 7. The vicinity of the lower end portion of the outer peripheral wall of the voice coil bobbin 7 is opposite to each of the inner peripheral walls of the annular magnet 2 and plate 3 with a constant space therebetween. On the other hand, the vicinity of the lower end portion of the inner peripheral wall of the voice coil bobbin 7 is opposite to the outer peripheral wall of the pole portion 1*a* being a component of the yoke 1 with a constant space. A gap (magnetic gap 16) is formed between the outer peripheral wall of the pole portion 1*a* and the inner peripheral wall of the plate 3.

The voice coil 8 has a pair of positive/negative lead wires (not shown). A lead wire at the positive side is an input wiring for an L (or R) channel signal, and a lead wire at the negative side is an input wiring for a ground (GND: ground) signal. Each of the lead wires is electrically connected to one end side of each terminal member 5 positioned on a second flat portion 4*b* of the frame 4 via each of tinsel cords (not shown). On the other hand, the other end side of each terminal member 5 is electrically connected to each input wiring of the amplifier. Therefore, the electric signal of one channel is inputted to the voice coil 8 from the amplifier via each of terminal members 5, each of the tinsel cords (not shown) and each of the lead wires.

The damper 6 is formed into an annular shape, and has an elastic portion formed with concentric corrugations, The outer peripheral edge portion of the damper 6 is fixed onto the second flat portion 4*b* of the frame 4, and the inner peripheral edge portion of the damper 6 is fixed to the outer peripheral wall of the voice coil bobbin 7.

Figure 2A:
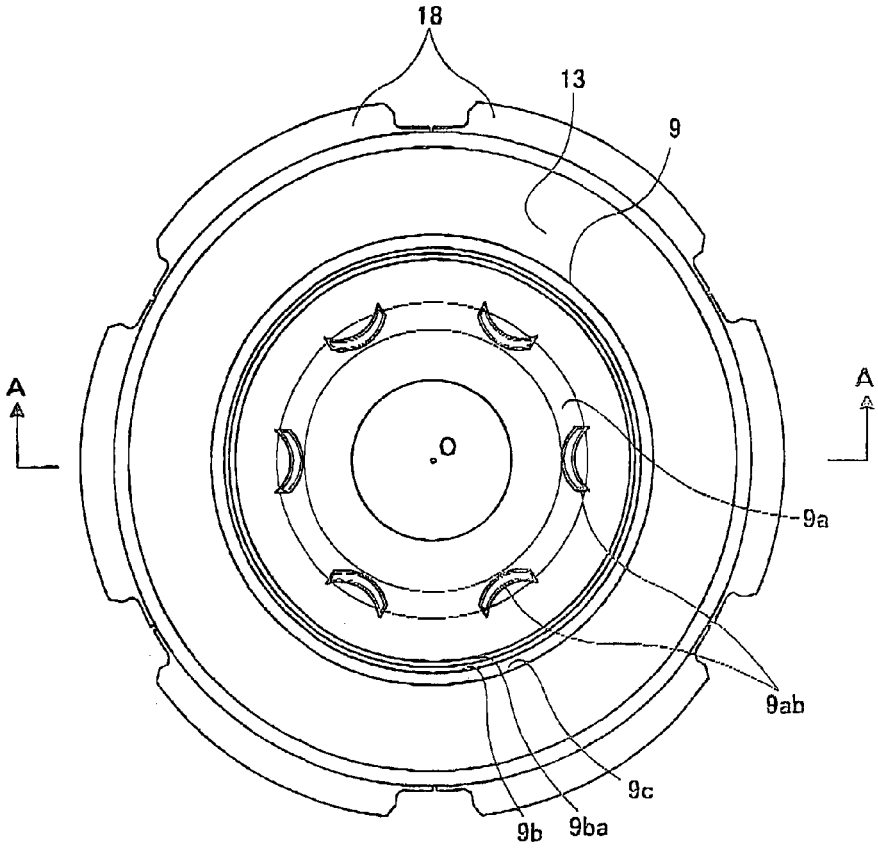
FIGS. 2A and 2B show a plan view and a cross-sectional view of a diaphragm according to the first embodiment.
Figure 2B:
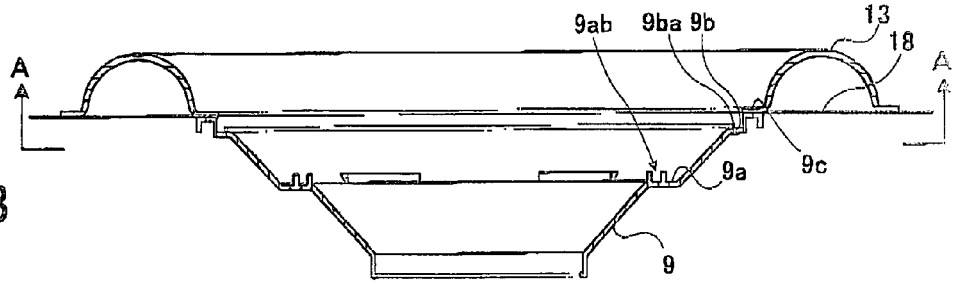

Various kinds of materials such as paper, high polymer and metal can be applied to the diaphragm 9 in accordance with the various use purposes. FIGS. 2A and 2B show a configuration of the diaphragm 9. FIG. 2A shows a plan view of the diaphragm 9 observed from the direction opposite to an arrow Y1 shown in FIG. 1 (i.e., a backside plan view of the diaphragm 9 observed from the lower side of FIG. 1). FIG. 2B shows a cross-sectional view of the diaphragm 9 taken along a cut line A-A' including a central point O in FIG. 2A. As shown in FIGS. 2A and 2B, the diaphragm 9 formed into a so-called cone shape has a first flat portion 9*a*, a second flat portion 9*b* and a third flat portion 9*c*, whose upper surfaces ensure flatness. The first flat portion 9*a* is formed at a substantially middle position of the upper surface (front side) of the diaphragm 9. On the first flat portion 9*a*, plural recessed portions 9*ab* formed into a shape similar to an arch-shape are formed along the direction of the circumference with an appropriate space. The second flat portion 9*b* is formed in the vicinity of the outer peripheral edge portion of the upper surface of the diaphragm 9, i.e., at a position in the vicinity of the third flat portion 9*c*. On the second flat portion 9*b*, a projecting portion 9*ba* is formed along the direction of the circumference. The third flat portion 9*c* is formed at the outer peripheral edge portion of the upper surface of the diaphragm 9. Onto the third flat portion 9*c*, the inner peripheral edge portion of the mounting member 18 formed into the substantially annular shape is mounted. The mounting member 18 functions to stably mount the diaphragm 9 onto the frame 4. On the upper surface of the inner peripheral edge portion of the mounting member 18, the inner peripheral edge portion of the edge 13, formed into a substantially half round shape when cross-sectionally observed, is mounted. On the other hand, in the vicinity of the outer peripheral edge portion of the mounting member 18, the outer peripheral edge portion of the edge 13 is mounted. As shown in FIG. 1, the inner peripheral edge portion of the diaphragm 9 is mounted onto an area in the vicinity of the upper end portion of the outer peripheral wall of the voice coil bobbin 7 via an adhesive 10. In addition, the inner peripheral edge portion of the diaphragm 9 is also fixed to the inner peripheral edge portion of the damper 6 via the adhesive 10. As shown in FIG. 1, the lower surface of the outer peripheral edge portion of the mounting member 18 is fixed onto the third flat portion 4*c* of the frame 4.

Figure 3A:
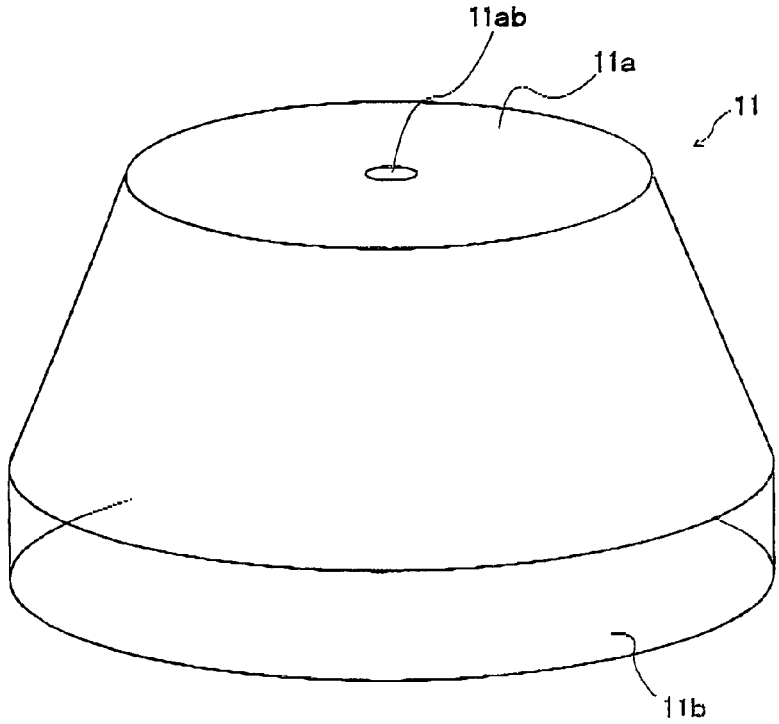
FIGS. 3A and 3B show a perspective view and a cross-sectional view of a supporting cap according to the first embodiment.
Figure 3B:
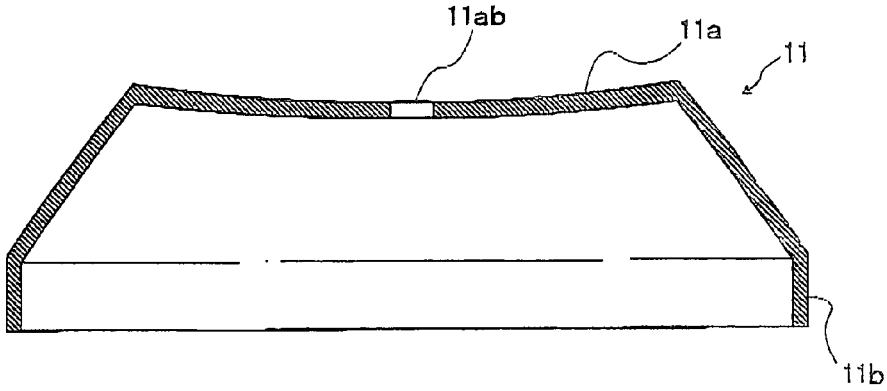

A supporting cap 11 is mounted on the side of the lower surface of a cap 12 and at a position covering the upper surface of the voice coil bobbin 7. FIGS. 3A and 3B show a configuration of the supporting cap 11. FIG. 3A shows a perspective view of the supporting cap 11. FIG. 3B shows a cross-sectional view when cutting the supporting cap 11 shown in FIG. 3A by a plane including a central axis thereof. As shown in FIGS. 3A and 3B, the supporting cap 11 is formed into a substantially cup shape, and has an upper surface 11*a* and an outer peripheral edge portion 11*b*. At the substantial center of the upper surface 11*a*, an opening 11*ab* is formed. As shown in FIG. 1, a projecting portion 12*a* of the cap 12, which will be described later, is inserted into the opening 11*ab* of the supporting cap 11 having such a configuration, and the supporting cap 11 is mounted on the side of the lower surface of the cap 12. In addition, the supporting cap 11 is arranged at the position covering the upper surface of the voice coil bobbin 7, and the outer peripheral edge portion of the supporting cap 11 is fixed to a position in the vicinity of the upper end portion of the outer peripheral wall of the voice coil bobbin 7 via the adhesive 10.

Figure 4A:
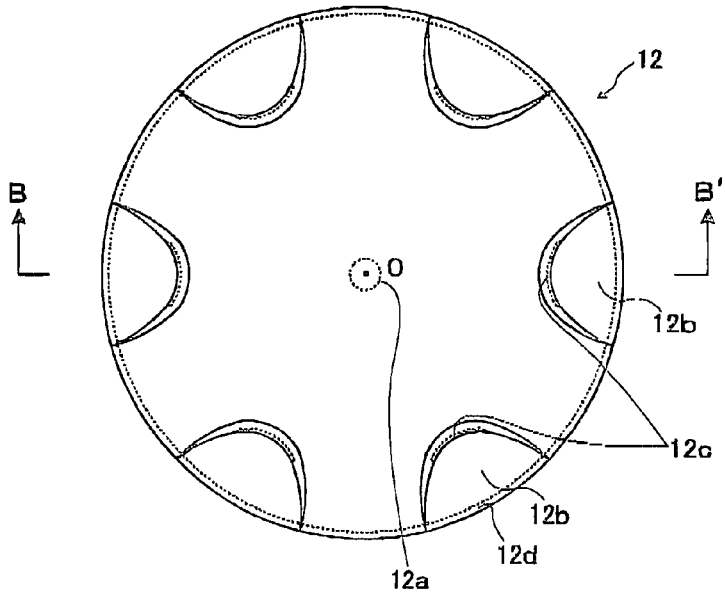
FIGS. 4A and 4B show a plan view and a cross-sectional view of a cap according to the first embodiment.
Figure 4B:
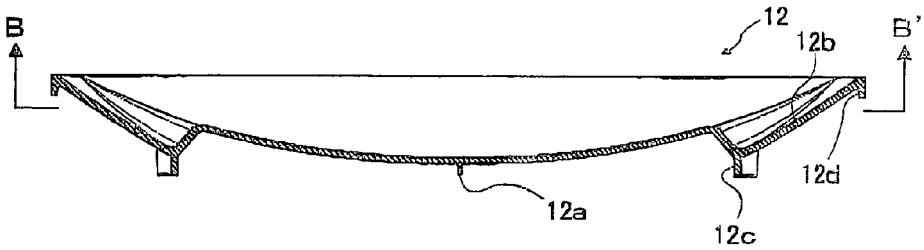

The cap 12 is mounted on the diaphragm 9 so as to cover the upper surface of the diaphragm 9. Thereby, the cap 12 has a function of preventing dust and a foreign material from entering the speaker device 100. FIGS. 4A and 4B show a configuration of the cap 12. FIG. 4A shows a plan view of the cap 11 observed from the direction opposite to the arrow Y1 shown in FIG. 1 (i.e., a backside plan view of the cap 12 observed from the lower portion of FIG. 1). FIG. 4B shows a cross-sectional view of the cap 11 taken along a cut line B-B' including the central point O shown in FIG. 4A. As shown in FIGS. 4A and 4B, the cap 12 is formed into a substantially disc-type plan shape, and has the projecting portion 12*a*, plural recessed portion 12*b*, plural projecting portions (ribs) 12*c* and a claw portion 12*d*. The projecting portion 12*a* projects from the substantially central position on the lower surface of the cap 12. The projecting portion 12*a* is inserted into the opening 11*ab* of the supporting cap 11. Thereby, the projecting portion 12*a* has a function of positioning the supporting cap 11 at the appropriate position of the cap 12. The plural recessed portions 12*b* are formed along the circumferential direction in the vicinity of the outer peripheral edge portion of the upper surface of the cap 12 and with an appropriate space. Each of the projecting portions 12*c* is formed into the substantially arch-shape, and projects from the lower surface of each of the correspondent recessed portions 12*b*. The claw portion 12*d* is formed into a hook shape, and is formed at the outer peripheral edge portion of the lower surface of the cap 12 and along the circumferential direction. It is noted that the mounting structure of the cap 12 onto the diaphragm 9 will be described later.

In the above-mentioned speaker device 100, the electric signal outputted from the amplifier is outputted to the voice coil 8 via each of the terminal members 5, each of the tinsel cords (not shown) and each of the lead wires. Thereby, driving force occurs to the voice coil 8 in the magnetic gap 16, and vibrates the diaphragm 9 in the axis direction of the speaker device 100. In this way, the speaker device 100 emits acoustic waves in the direction of the arrow Y1.

(Mounting Structure of Cap and Diaphragm)

Figure 5:
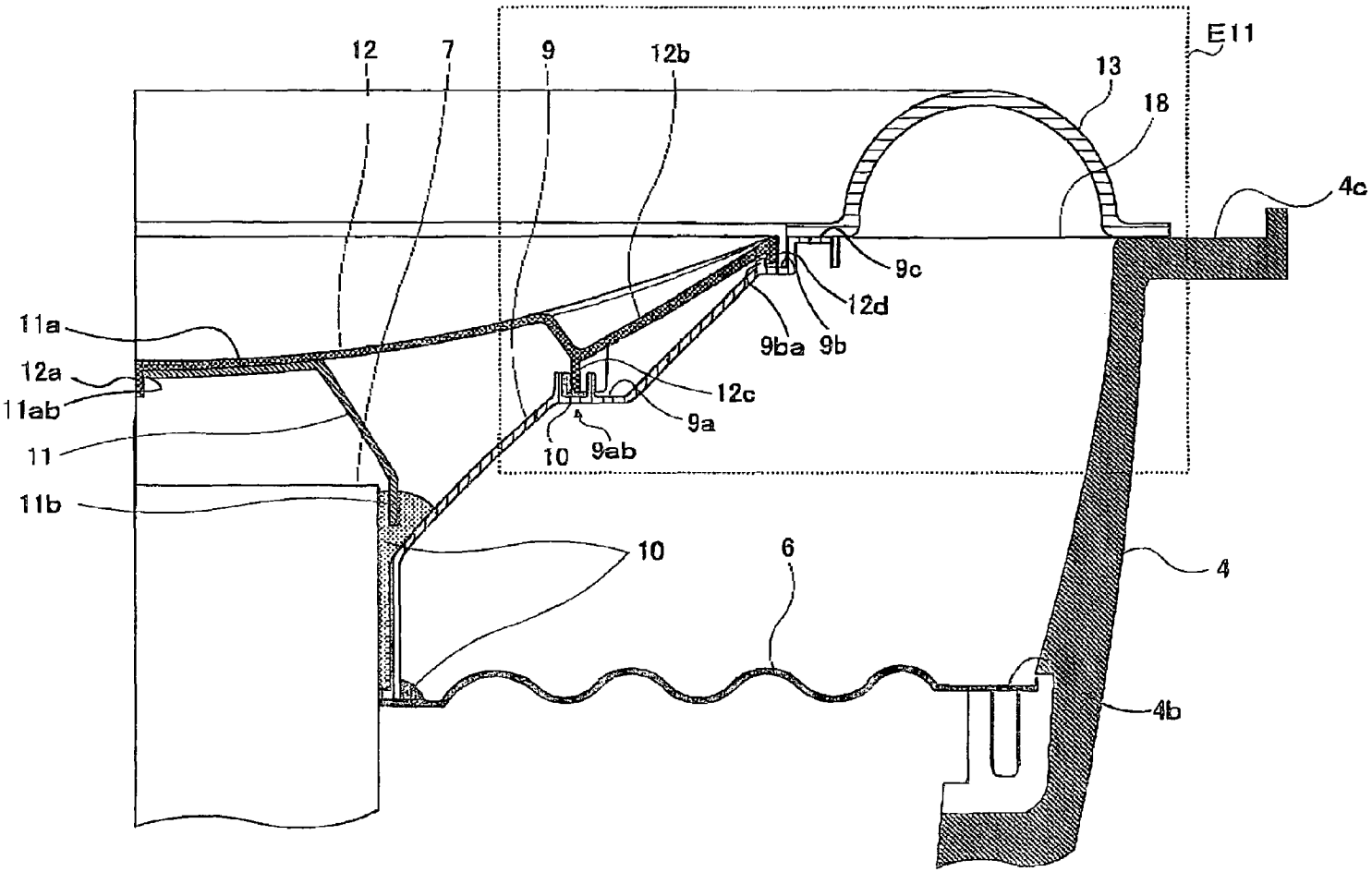
FIG. 5 is a partly cross-sectional view showing amounting structure of the cap and the diaphragm according to the first embodiment.

Next, the description will be given of the mounting structure of the cap and the diaphragm, which is the characteristic of the present invention, with reference to FIG. 5. FIG. 5 is a cross-sectional view in which a broken line area E10 shown in FIG. 1 is enlarged, and it particularly illustrates the mounting structure of the cap 12 and the diaphragm 9. It is noted that the description will be mainly given of components being the characteristic of the present invention below.

The inner peripheral edge portion of the diaphragm 9 is mounted onto a position in the vicinity of the upper end portion of the outer peripheral wall of the voice coil bobbin 7 via the adhesive 10. The projecting portion 12*a* of the cap 12 is inserted into the opening 11*ab* of the supporting cap 11, and the upper surface 11*a* of the supporting cap 11 contacts the correspondent lower surface of the cap 12. Thereby, the supporting cap 11 is mounted onto the appropriate position of the cap 12.

The inner peripheral wall of the claw portion 12*d* of the cap 12 contacts the outer peripheral wall of the projecting portion 9*ba* of the diaphragm 9, and the claw portion 12*d* is fixed to the projecting portion 9*ba* and the third flat portion 9*c* (hereinafter also referred to as "first fixing portion") via an adhesive (not shown). Each projecting portion 12*c* of the cap 12 is inserted into each correspondent recessed portion 9*ab* of the diaphragm 9 to be fixed into the recessed portion 9*ab* (hereinafter also referred to as "second fixing portion") via the adhesive 10. In this manner, the cap 12 is mounted on the diaphragm 9. The outer peripheral edge portion 11*b* of the supporting cap 11 is arranged at the position in the vicinity of the upper end of the voice coil bobbin 7 to be fixed thereto via the adhesive 10 (hereinafter also referred to as "third fixing portion").

Figure 6:
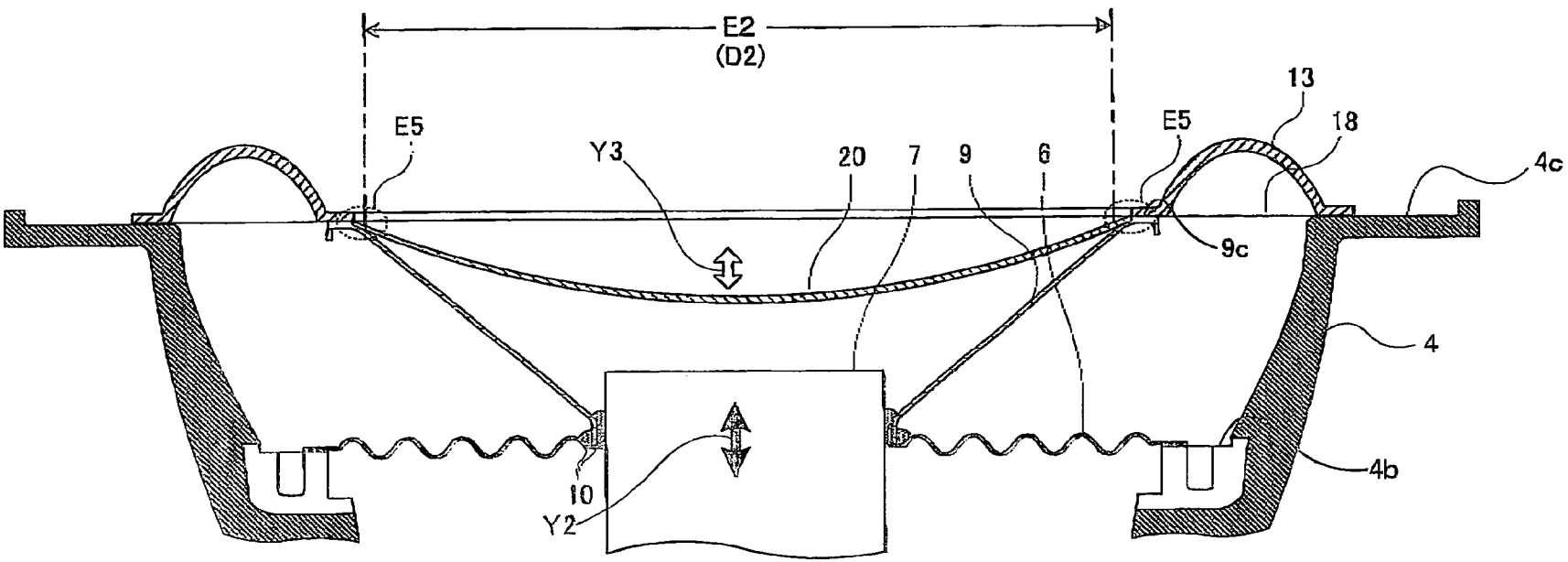
FIG. 6 is a partly cross-sectional view showing the mounting structure of the cap and the diaphragm according to a comparative example.

Next, the description will be given of characteristic operation and effect of the present invention in comparison with a comparative example. FIG. 6 shows a partly perspective view of a speaker device according to the comparative example. The same reference numerals are given to the same components as the components of the present invention below, and an explanation thereof will be simplified.

First, the description will be given of the main components of the speaker device according to the comparative example. As shown in FIG. 6, the inner peripheral edge portion of the damper 6 is mounted on the outer peripheral wall of the voice coil bobbin 7 via the adhesive 10, and the outer peripheral edge portion of the damper 6 is mounted on the second flat portion 4*b* of the frame 4. The inner peripheral edge portion of the diaphragm 9 is mounted onto the area in the vicinity of the upper end portion on the outer peripheral wall of the voice coil bobbin 7 via the adhesive 10. The inner peripheral edge portion of the diaphragm 9 and the inner peripheral edge portion of the damper 6 are attached to each other by the adhesive 10. A cap 20 is formed into a substantial disc-type plan shape, and has the substantially same size (area) as the size of the cap 12 of the present invention. The outer peripheral edge portion of the cap 20 is mounted on the area in the vicinity of the outer peripheral edge portion (an area corresponding to the broken line area E5) of the diaphragm 9 via the adhesive 10 (not shown). The inner peripheral edge portion of the mounting member 18 is mounted on the third flat portion 4*c* of the diaphragm 9, and the outer peripheral edge portion of the mounting member 18 is mounted onto the third flat portion 4*c* of the frame 4. The inner peripheral edge portion of the edge 13 is mounted onto the inner peripheral edge portion of the mounting member 18, and the outer peripheral edge portion of the edge 13 is mounted onto the outer peripheral edge portion of the mounting member 18. Therefore, the inner peripheral edge portion of the edge 13 is opposite to the third flat portion 9*c* of the diaphragm 9 via the mounting member 18, and the outer peripheral edge portion of the edge 13 is opposite to the third flat portion 4*c* of the frame 4 via the mounting member 18.

Next, the description will be given of the characteristic operation and effect of the present invention in comparison with the comparative example, with reference to FIG. 1, FIG. 5 and FIG. 6.

In the comparative example, the cap 20 is fixed to the one portion of the diaphragm 9 corresponding to the broken line area E5 via the adhesive (not shown). When the voice coil bobbin 7 is driven in the direction of an arrow Y2, the cap 20 accordingly vibrates in the direction of an arrow Y3, too. At this time, the area in which the cap 20 vibrates becomes an area E2 other than the attached area. The area E2 substantially corresponds to the area of the portion of the cap 20 having a diameter D2. Like this, in the comparative example, since the adhesion area of the cap 20 and the diaphragm 9 is small and the vibrating area E2 is large compared with the whole area of the cap 20 (corresponding to the total area of the cap 20), the abnormal sound (flutter) occurs from the cap 20 due to the vibration In addition, since the adhesion area of the cap 20 and the diaphragm 9 is small, the bonding strength therebetween is also small.

On the contrary, in the present invention, as shown in FIG. 1 and FIG. 5, the cap 12 is fixed to the second fixing portion corresponding to the substantially middle position of the cap 12 and the first fixing portion in the vicinity of the outer peripheral edge portion of the cap 12 via the adhesive 10. Namely, the cap 12 is fixed to the diaphragm 9 in a manner being divided into two portions corresponding to the area E1 and an area E3 with the middle position of the cap 12 serving as the border. As shown in FIG. 1, when the voice coil bobbin 7 is driven in the direction of the arrow Y2, the cap 12 accordingly vibrates in the direction of the arrow Y3, too.

At this time, the area in which the cap 12 vibrates becomes the area on the inner side of the second filling portion, i.e., the area E1 (<E2), and the area E3 on the outer side of the second fixing portion hardly vibrates. This is mainly because the supporting strength of the diaphragm 9 in the area E3 on the outer side of the second fixing portion is larger than the supporting strength in the area E1 on the inner side of the second fixing portion and hence the area E3 is hard to vibrate. Therefore, in the speaker device 100, at the time of the driving thereof, since the area in which the cap 12 vibrates is small, it can be prevented that the abnormal sound (flutter) occurs from the cap 12. In addition, as described above, since the cap 12 and the diaphragm 9 are bonded at the first and second fixing portions, the bonding area therebetween increases as described above. Thus, without making the diaphragm 9 and the cap 12 thick, the occurrence of the abnormal sound from the cap 12 can be prevented. Moreover, the strength of the diaphragm 9 and the bonding strength of the diaphragm 9 and the cap 12 can be improved. Therefore, the diaphragm 9 and the cap 12 can be lighter, and the sensitivity of the speaker device 100 can be improved.

Additionally, in the present inventions the supporting cap 11 is further provided, and the outer peripheral edge portion thereof is fixed to the third fixing portion. Therefore, the bonding strength of the cap 12 and the diaphragm 9 can be further improved.

Second Embodiment

In a second embodiment, by providing the ventilation portion on the above-mentioned components of the speaker device 100, e.g., the supporting cap 11, the mechanical resistance at the time of the movement of the vibration system 30 is reduced. Thereby, the deterioration of the sound quality can be prevented.

First, the outline of the second embodiment will be explained with reference to FIG. 1.

In the speaker device 100 shown in FIG. 1, a space S1 among the diaphragm 9, the edge 13, the frame 4 and the damper 6 and a space S2 among the diaphragm 9, the cap 12 and the supporting cap 11 are closed, respectively In addition, a space S3 among the voice coil bobbin 7 formed into a substantially cylindrical shape, the supporting cap 11 and the pole portion 12 is connected to a space S4 among the magnet 2, the plate 3 and the yoke 1 via the magnetic gap 16.

In the speaker device 100 having such a configuration, when the voice coil bobbin 7 is assumed to move in the direction of the arrow Y1, the supporting cap 11 accordingly moves in the direction away from the pole portion 1*a*, Thus, one part of the air existing in the space S4 flows into the space S3 via the magnetic gap 16, and the volume of the space S3 gradually becomes large. Thereby, the pressure in the space S3 becomes low. On the contrary, in the speaker device 100, when the voice coil bobbin 7 is assumed to move in the direction opposite to the arrow Y1, the supporting cap 11 accordingly moves in the direction toward the upper surface of the pole portion 1*a*. Thus, the one part of the air existing in the space S3 is discharged into the space S4 via the magnetic gap 16, and the volume of the space S3 gradually becomes small. Namely, in this case, the space S3 is compressed, and the pressure in the space S3 becomes high.

As described above, in the above-mentioned speaker device 100, in accordance with the movement of the voice coil-bobbin 7 in the direction of the arrow Y2, the volume of the space S3 becomes large, or conversely becomes small. Particularly, when the voice coil bobbin 7 moves in the direction opposite to the arrow Y1, the pressure in the space S3 becomes high. Therefore, the voice coil bobbin 7 is hard to move in the direction opposite to the arrow Y1. Namely, in this case, the mechanical resistance at the time of the movement of the voice coil bobbin 7 increases. Therefore, due to the degree of the mechanical resistance at the time of the movement of the voice coil bobbin 7, it may become difficult to appropriately vibrate the diaphragm 9, and the sound quality may deteriorate.

Hence, in order to avoid the occurrence of such a problem, the mechanical resistance at the time of the movement of the voice coil bobbin 7 has to be decreased by some sort of countermeasure.

In order to achieve such a object, by providing the ventilation portion on the supporting cap 11, it is realized that the air can freely flow at least between the space S2 and the space S3. If such a configuration is employed, in FIG. 1, when the voice coil bobbin 7 is assumed to move in the direction opposite to the arrow Y1, the one part of the air existing in the space S3 is discharged to the space S4, as described above. At this time, the one part of the air existing in the space S2 flows into the space S3 via the ventilation portion provided on the supporting cap 11. Therefore, in this case, in comparison with the supporting cap 11 having no ventilation portion, the pressure in the space S3 can be low, and the voice coil bobbin 7 can easily move in the direction opposite to the arrow Y1. Namely, in this case, the mechanical resistance at the time of the movement of the voice coil bobbin 7 can be decreased.

Based on the above-mentioned consideration result, as a concrete countermeasure thereof, in the second embodiment, the ventilation portions, i.e., plural openings, are provided at predetermined positions of the supporting cap 11. In addition, in the second embodiment, plural openings functioning as the ventilation portions are provided on the diaphragm 9 and the frame 4 so that the mechanical resistance at the time of the movement of the voice coil bobbin 7 can be further decreased.

Figure 8A:
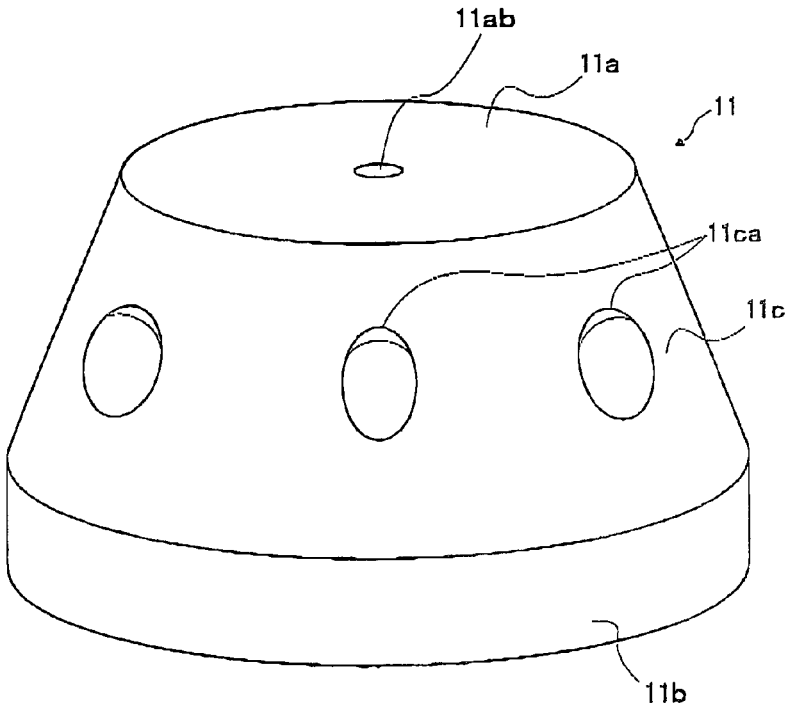
FIGS. 8A and 8B show a perspective view and a cross-sectional view of a supporting cap according to a second embodiment of the present invention.
Figure 8B:
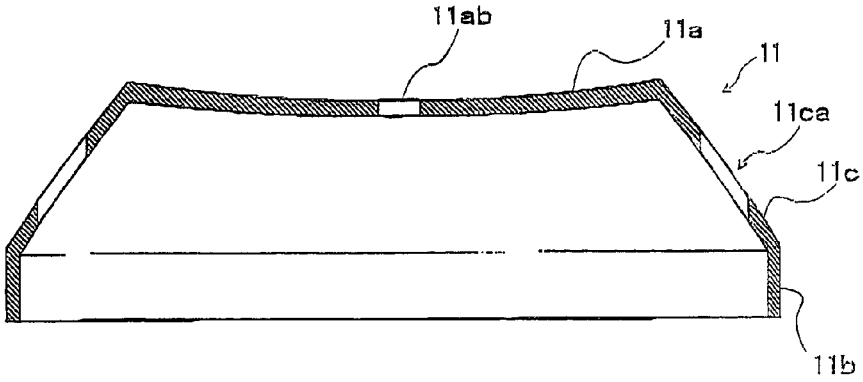
Figure 9A:
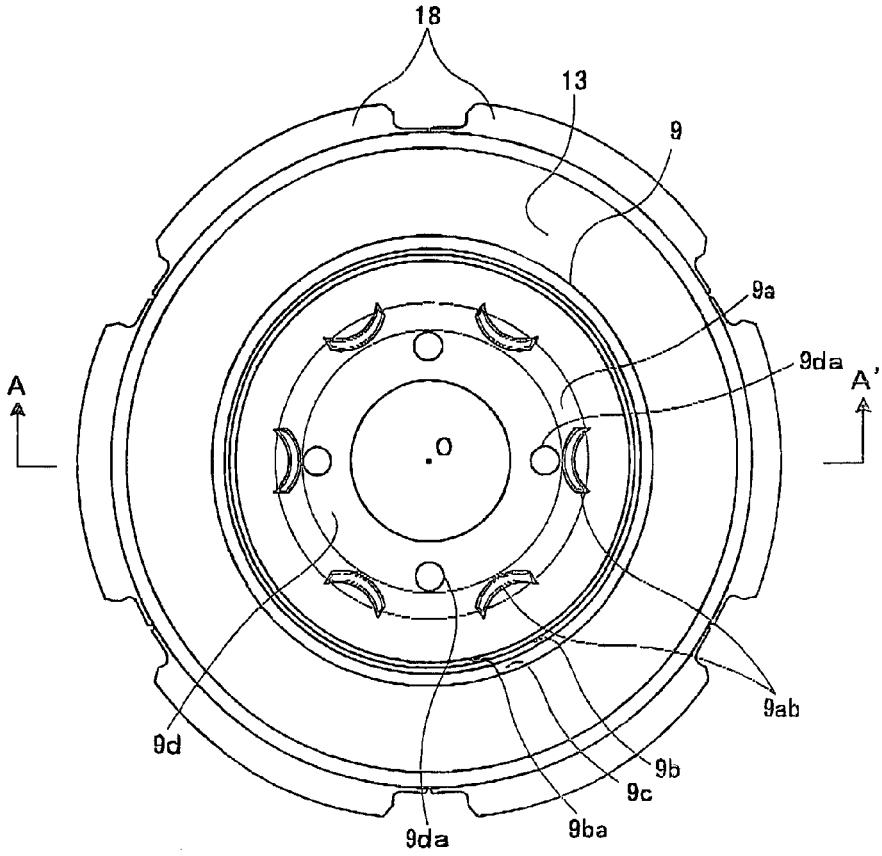
FIGS. 9A and 9B show a plan view and a cross-sectional view of the diaphragm according to the second embodiment.
Figure 9B:
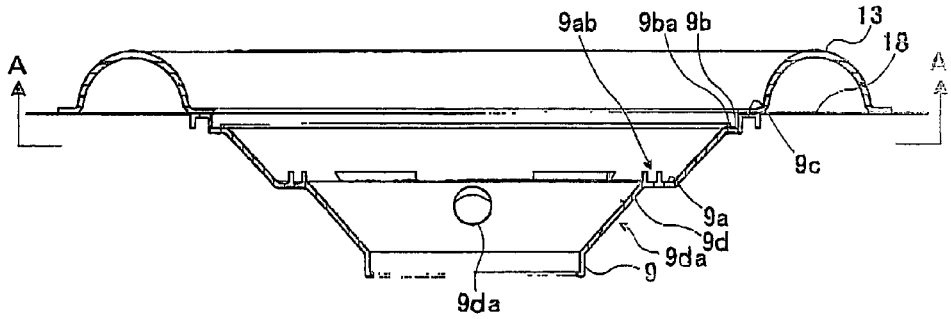
Figure 10:
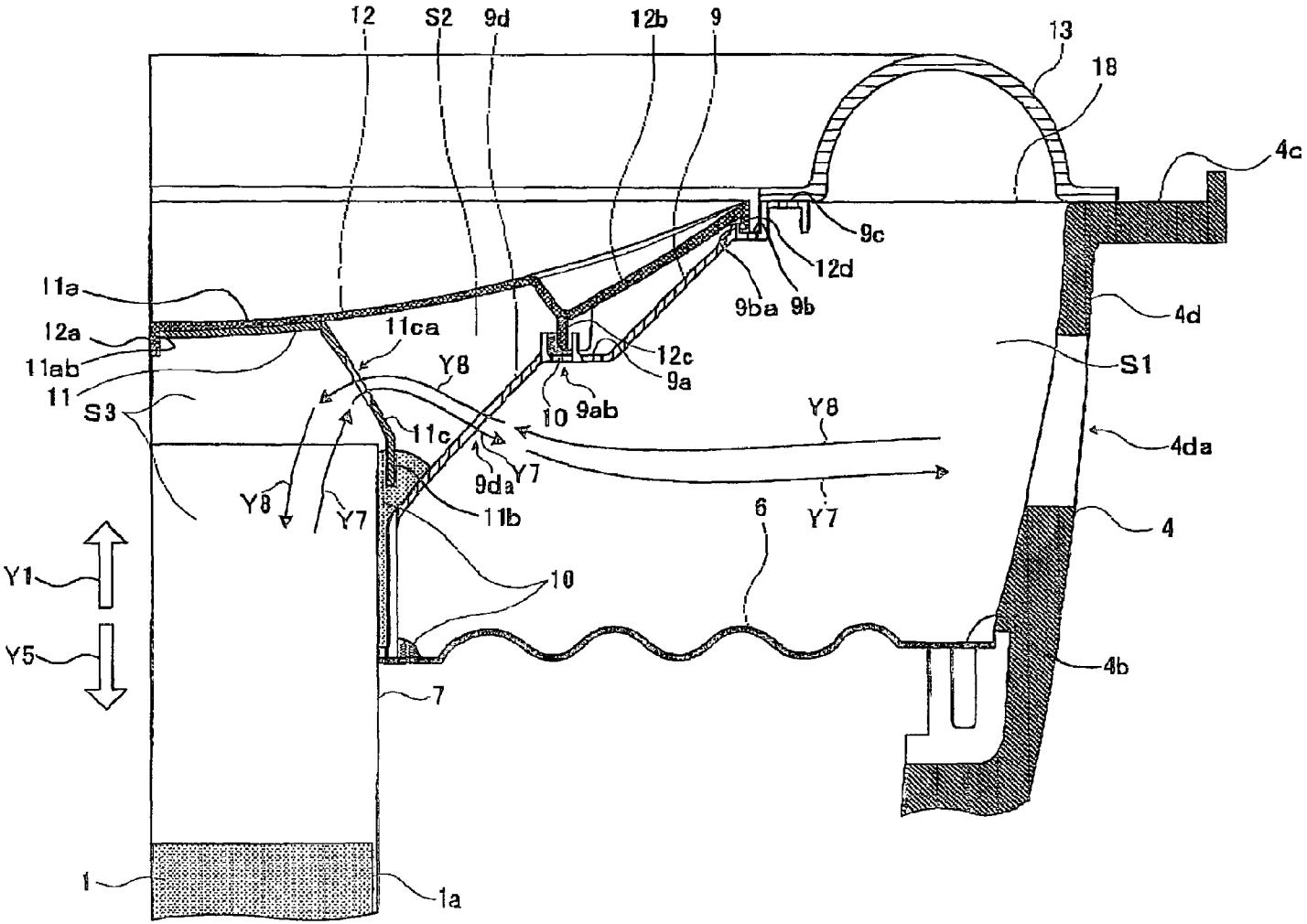
FIG. 10 is a partly cross-sectional view of the speaker device explaining operation and effect of a ventilation portion of the second embodiment.

FIGS. 8A and 8B show the configuration of the supporting cap 11 having the plural openings functioning as the ventilation portions. FIG. 8A shows a perspective view of the supporting cap 11 having the plural openings, and FIG. 8B shows a cross-sectional view when cutting the supporting cap 11 shown in FIG. 8A by a plane including a central axis thereof. Other than such a point that the supporting cap 11 shown in FIGS. 8A and 8B has the plural openings, the configuration of the supporting cap 11 shown in FIGS. 8A and 8B is similar to the configuration of the supporting cap 11 shown in FIGS. 3A and 3B. In addition, FIGS. 9A and 9B show the configuration of the diaphragm 9 having the plural openings functioning as the ventilation portions. FIG. 9A shows a plan view of the diaphragm 9 having the plural openings, and FIG. 9B shows a cross-sectional view taken along a cut line A-A' including a central point O in FIG. 9A. Other than such a point that the diaphragm 9 shown in FIGS. 9A and 9B has the plural openings, the configuration of the diaphragm 9 shown in FIGS. 9A and 9B are same as the configuration of the diaphragm 9 shown in FIGS. 2A and 2B. In addition, FIG. 10 shows the frame 4 having the plural openings functioning as the ventilation portions. FIG. 10 is a cross-sectional view substantially corresponding to FIG. 5, and the pole portion 1*a* is also shown in FIG. 10 for ease of explanation. It is noted that the only one opening is shown for convenience of the illustration in FIG. 10.

First, as shown in FIGS. 8A and 8B, the supporting cap 11 has a side wall 11*c* between the upper surface 11*a* and the outer peripheral edge portion 11*b*. It is noted that the upper surface 11*a*, the outer peripheral edge portion 11*b* and the side wall 11*c* are integrally formed. On the side wall 11*c*, plural openings 11*ca* are formed along the circumferential direction and with the appropriate space. The plural openings 11*ca* function as the above-mentioned ventilation portions.

Next, as shown in FIGS. 9A and 98, the diaphragm 9 has a side wall 9*d* between the first flat portion 9*a* and the inner peripheral edge portion. On the side wall 9*d*, plural openings 9*da* are formed along the circumferential direction and with the appropriate space. Next, as shown in FIG. 10, the frame 4 has plural openings 4*da*. The plural openings 4*da* are formed on a side wall 4*d* positioned between the second flat portion 4*b* and the third flat portion 4*c*. In addition, the plural openings 4*da* are formed along the circumferential direction of the side wall 4*d* and with the appropriate space.

FIG. 10 shows the state that the supporting cap 11, the diaphragm 9 and the frame 4 having the above-mentioned ventilation portions are mounted onto the speaker device 100.

In FIG. 10, the plural openings 11*ca* of the supporting cap 11 neighbor and face the space S2 existing among the diaphragm 9, the side wall 11*c* of the supporting cap 11 and the cap 12 and the space S3 existing among the supporting cap 11, the inner peripheral wall of the voice coil bobbin 7 and the pole portion 1*a*, respectively. The space S2 and the space S3 are connected via the plural openings 11*ca*. In addition, the plural openings 9*da* of the diaphragm 9 neighbor and face the space S2 and the space S1 existing among the diaphragm 9, the edge 13, the side wall 4*d* of the frame 4 and the damper 6, respectively. The space S1 and the space S2 are connected via the plural openings 9*da*. Moreover, the plural openings 4*da* of the frame 4 neighbor and face the space S1 and the external space of the speaker device 100, respectively, and the space S1 and the external space are connected via the plural openings 4*da*. Therefore, in the second embodiment, via the above-mentioned respective openings, the space S4 (see FIG. 1), the space S3, the space S2, the space S1 and the external space are connected to each other.

In the second embodiment having the above-mentioned configuration, at the time of the driving of the speaker device 100, the voice coil bobbin 7 moves in the direction of the arrow Y1 and in the direction of an arrow Y5 opposite to the arrow Y1.

When the voice coil bobbin 7 is assumed to move in the direction of the arrow Y1, as understood with reference to FIG. 1 and FIG. 10, the part of the air existing in the space S4 flows into the space S3, and by the amount of flowing air, the part of the air existing in the space S3 is discharged to the space S2 via the plural openings 11*ca* of the supporting cap 11, as shown in the direction of an arrow Y7. Accordingly, by the amount of air flowing into the space S2, the part of the air existing in the space S2 is discharged to the space S1 via the plural openings 9*da* of the diaphragm 9, as shown in the direction of the arrow Y7. Further, by the amount of air flowing into the space S1, the part of the air existing in the space S1 is discharged to the external space via the plural openings 4*da* of the frame 4, as shown in the direction of the arrow Y7.

On the other hand, when the voice coil bobbin 7 is assumed to move in the direction of the arrow Y5, as understood with reference to FIG. 1 and FIG. 10, the part of the air existing in the space S3 is discharged to the space 34. Accordingly, by the amount of the air discharged from the space S3, the part of the air existing in the space S2 flows into the space S3 via the plural openings 11*ca* of the supporting cap 11, as shown in the direction of an arrow Y8. In conjunction with this, by the amount of air discharged from the space S2, the part of the air existing in the space S1 flows into the space S2 via the plural openings 9*da* of the diaphragm 9, as shown in the direction of the arrow Y8. By the amount of the air discharged from the space S1, the part of the air existing in the external space flows into the space S1 via the plural openings 4*da* of the frame 4.

As described above, in the speaker device 100 having no ventilation portion, when the voice coil bobbin 7 moves in the direction of the arrow Y5 opposite to the direction of the arrow Y1, the pressure of the space S3 becomes high, and the voice coil bobbin 7 is hard to move. Namely, the mechanical resistance at the time of the movement of the voice coil bobbin 7 increases.

As for this point, in the second embodiment, since the plural openings are provided on the supporting cap 11, the diaphragm 9 and the frame 4, the permeability becomes preferable. Therefore, in the speaker device 100 in the second embodiment, particularly, even when the voice coil bobbin 7 moves in the direction of the arrow Y5, the pressure in the space S3 never becomes high by the above-mentioned operation. Thus, in this case, the voice coil bobbin 7 can easily move in the direction of the arrow Y5, and the mechanical resistance at the time of the movement of the voice coil bobbin 7 can be decreased. Thereby, the deterioration of the sound quality can be prevented.

In addition, in the speaker device 100, when the pressure in the space S3 becomes high as described above, external force corresponding to the pressure operates on each component of the vibration system 30. Thus, in this case, the strength (bonding strength) among the respective components of the vibration system 30 has to be reinforced. As for this point, in the second embodiment, since the permeability is ensured, the pressure in the space S3 does not become high, as described above. Therefore, the strength (bonding strength) among the respective components of the vibration system 30 does not have to be reinforced in a positive manner. Namely, in the second embodiment, since the ventilation portion is provided, the strength (bonding strength) among the respective components of the vibration system 30 becomes high at the time of the driving of the speaker device 100 in comparison with the speaker device having no ventilation portion. This is the reinforcement effect. Thereby, it becomes possible to operate the vibration system 30 with appropriate softness. As a result, the vibration system 30 can be precisely controlled, and the speaker device 100 can be easily in a still state. Namely, the damping effect can be improved.

[Modification]

Figure 7:
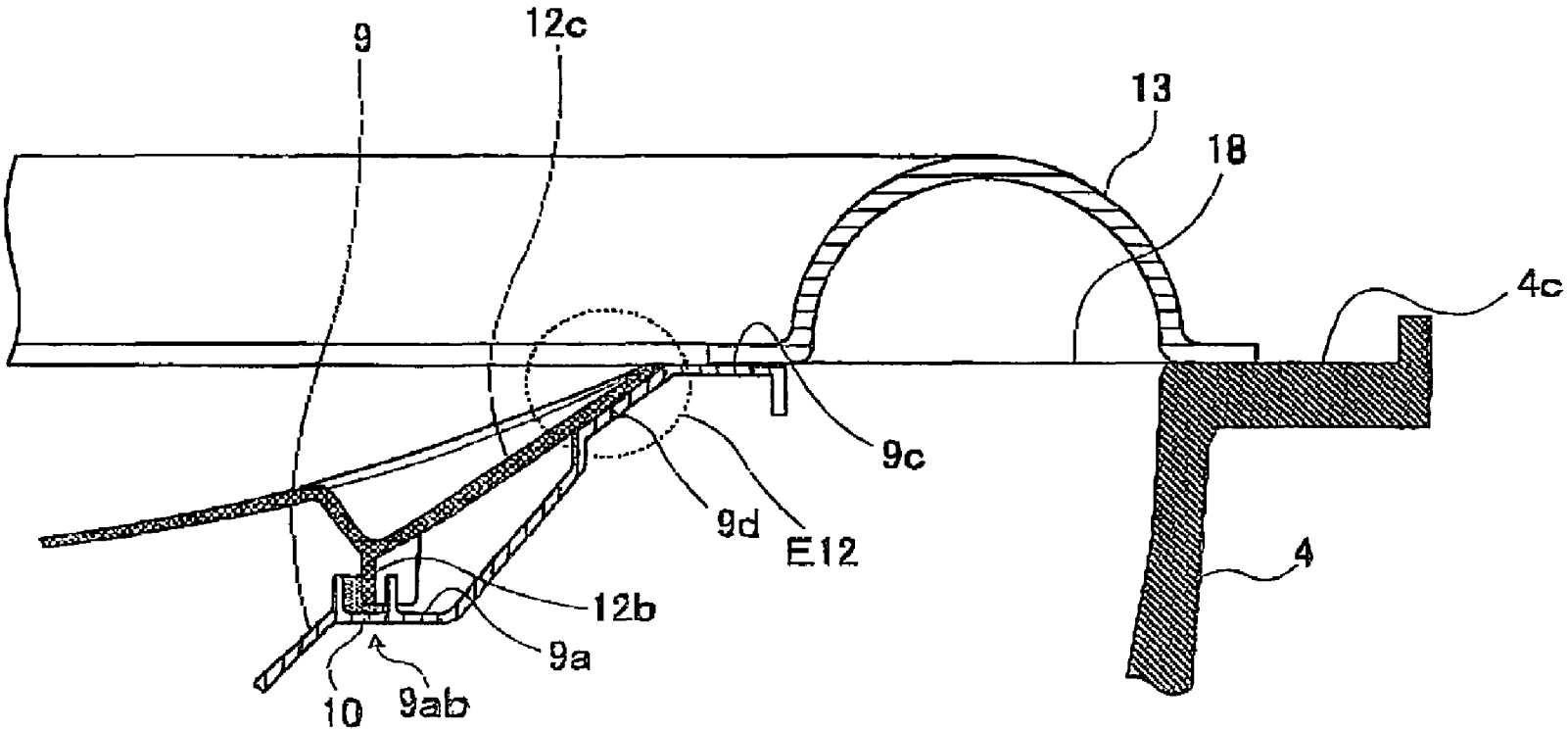
FIG. 7 is a partly cross-sectional view showing an example of the mounting structure of the cap and the diaphragm according to a modification.

In the present invention, the mounting structure (bonding manner) at the cap 12 and the outer peripheral edge portion of the diaphragm 9 is not limited to the above-mentioned structure, and other various manners can be employed. FIG. 7 shows an example of the bonding methods. FIG. 7 is a partly cross-sectional view corresponding to a broken line area E11 shown in FIG. 5.

As shown in FIG. 7, in this example, the bonding manner of the outer peripheral edge portion of the cap 12 and the diaphragm 9 is different from the above-mentioned embodiments. Namely, in this example, as shown in the broken line area E12 in FIG. 7, the second flat portion 9*b* and the projecting portion 9*ba* are not provided in the vicinity of the outer peripheral edge portion of the diaphragm 9. Instead, the portion of the diaphragm 9 corresponding to the broken line area E12 and the outer peripheral edge portion of the cap 12 structurally contact. In this example, the outer peripheral edge portion of the cap 12 and the diaphragm 9 at the correspondent position are fixed via the adhesive (not shown). By such a structure, the operation and effect of the present invention can be also obtained.

Figure 11A:
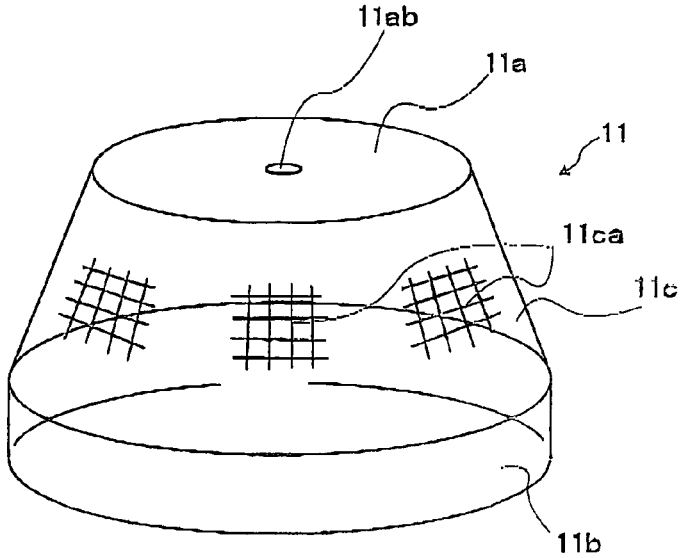
FIGS. 11A to 11C are perspective views of the supporting cap in which portions corresponding to plural openings on a side wall of the supporting cap, the entire side wall and the entire supporting cap are constructed by a material having permeability such as a fabric on which large meshes are formed, respectively.
Figure 11B:
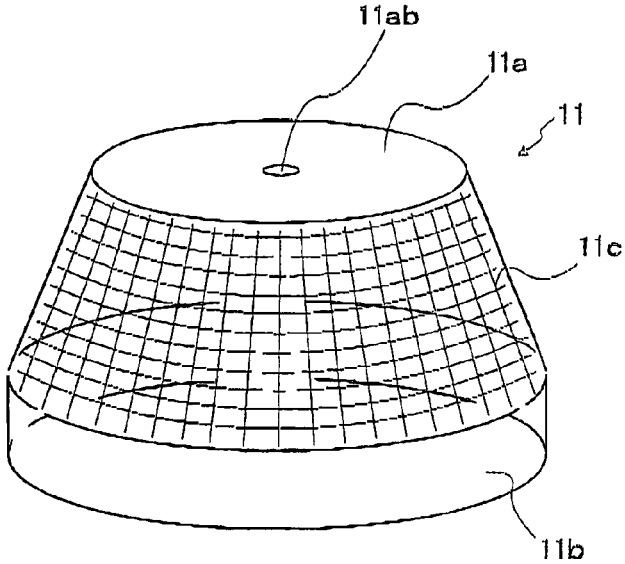
Figure 11C:
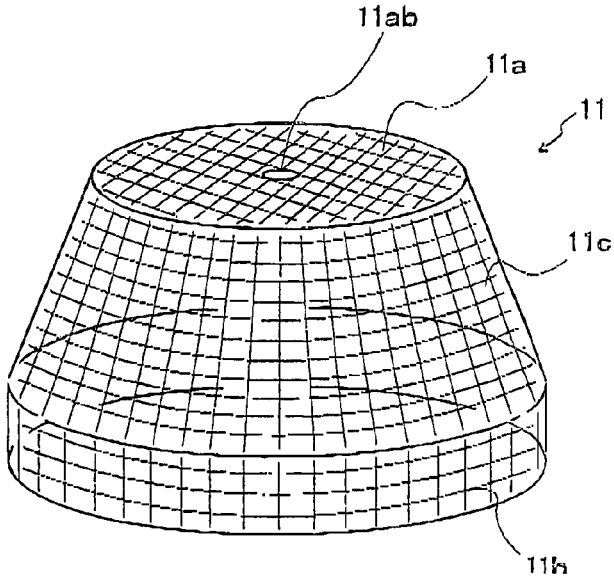

In addition, in the above-mentioned second embodiment, as the ventilation portions, the plural openings 11*ca* are provided on the side wall 11*c* of the supporting cap 11. However, this invention is not limited to this. As shown in FIG. 11A, the portions corresponding to the plural openings 11*ca* on the side wall 11*c* of the supporting cap 11 may be constructed by a member having the permeability, e.g., a material such as a fabric on which large meshes are formed. Instead, as shown in FIGS. 11B and 11C, the entire side wall 11*c* or the entire supporting cap 11 may be constructed by a member having the permeability, e.g., a material such as a fabric on which large meshes are formed. Thereby, since the member having the permeability functions as the ventilation portion, the operation and effect similar to those in the second embodiment can be obtained.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Applications No. 2004-309329 filed on Oct. 25, 2004 and No. 2004-374313 filed on Dec. 24, 2004 including the specifications, claims, drawings and summaries are incorporated herein by reference in their entirety.

What is claimed is:

1. A speaker device comprising:

a voice coil bobbin;

a diaphragm which is mounted on the voice coil bobbin; and a cap which is positioned in front of the diaphragm and at a position covering the voice coil bobbin, wherein the diaphragm has a first fixing portion in a vicinity of an outer peripheral portion thereof and a second fixing portion in a vicinity of a middle portion thereof, and wherein an outer peripheral portion of the cap is bonded to the outer peripheral portion of the diaphragm or the first fixing portion, wherein plural projecting portions, formed on the cap at positions closer to a center of the cap than the outer peripheral portion of the cap, are bonded to the second fixing portion, wherein the first fixing portion has a projecting portion on a side opposite to the cap and the outer peripheral portion of the cap has a hook-shape claw portion on a side opposite to the diaphragm, and wherein the claw portion and the projecting portion contact to be bonded.

2. The speaker device according to claim 1, wherein the second fixing portion has plural recessed portions on a side of the cap, and wherein the plural projecting portions are inserted into the plural correspondent recessed portions, and the plural projecting portions and the plural recessed portions are bonded.

3. The speaker device according to claim 1, wherein a supporting cap is provided between the voice coil bobbin and the cap, and wherein the supporting cap is bonded to the cap, and an outer peripheral portion of the supporting cap is bonded between the voice coil bobbin and the diaphragm by an adhesion component.

4. The speaker device according to claim 3, wherein the supporting cap has a contact surface contacting the cap, and has an opening at a substantial center of the contact surface, wherein the cap has a projecting portion projecting at a position corresponding to the opening and on a side opposite to the supporting cap, and wherein the projecting portion of the cap is inserted into the opening of the supporting cap.

5. The speaker device according to claim 1, further comprising an edge and a frame, wherein an inner peripheral portion of the edge is mounted onto the outer peripheral portion of the diaphragm, and an outer peripheral portion of the edge is mounted onto the frame.

6. The speaker device according to claim 3, wherein the supporting cap has a ventilation portion.

7. The speaker device according to claim 6, wherein the supporting cap has an opening at a position facing a space existing among the supporting cap, the diaphragm and the cap.

8. The speaker device according to claim 4, wherein the supporting cap has an opening between the contact surface and the outer peripheral portion.

9. The speaker device according to claim 6, wherein a portion of the supporting cap facing a space existing among the supporting cap, the diaphragm and the cap, a part of the portion or the entire supporting cap is formed by a material having permeability.

10. The speaker device according to claim 6, wherein the diaphragm has an opening at a position facing a space existing among the supporting cap, the diaphragm and the cap.

11. The speaker device according to claim 5, wherein the frame has an opening at a position facing a space existing among the frame, the diaphragm and the edge.

* * * * *